US007117541B2

(12) United States Patent
Hozack

(10) Patent No.: US 7,117,541 B2
(45) Date of Patent: Oct. 10, 2006

(54) GLOVE WITH AMMUNITION HOLDER

(76) Inventor: Murray G. Hozack, Box 486, Marwayne, Alberta (CA) T0B 2X0

( * ) Notice: Subject to any disclaimer, the term of this patent is extended or adjusted under 35 U.S.C. 154(b) by 0 days.

(21) Appl. No.: 10/958,990

(22) Filed: Oct. 4, 2004

(65) Prior Publication Data

US 2005/0183185 A1 Aug. 25, 2005

(30) Foreign Application Priority Data

Oct. 6, 2003 (CA) ..... 2444341

(51) Int. Cl.
*A41D 19/00* (2006.01)

(52) U.S. Cl. ..... 2/161.5

(58) Field of Classification Search ..... 2/158, 2/159, 160, 161.1, 161.2, 161.5, 161.6; 224/217, 224/218, 931
See application file for complete search history.

(56) References Cited

U.S. PATENT DOCUMENTS

| | | | | |
|---|---|---|---|---|
| 3,629,867 | A | 12/1971 | Taylor | |
| 4,247,097 | A | 1/1981 | Schwartz | |
| 4,330,120 | A * | 5/1982 | Netti | 482/105 |
| D306,366 | S | 2/1990 | Turpie | |
| 4,923,418 | A | 5/1990 | Hoffman | |
| 4,933,992 | A | 6/1990 | Kallman | |
| 5,003,637 | A * | 4/1991 | Lonon | 2/160 |
| 5,365,609 | A | 11/1994 | Herzog | |
| D356,657 | S * | 3/1995 | Hauswald | D29/116.2 |
| D359,154 | S | 6/1995 | Goodson | |
| D369,453 | S | 5/1996 | Robbins | |
| 5,768,710 | A | 6/1998 | Williams | |
| D410,331 | S | 6/1999 | Hamilton | |
| 6,205,588 | B1 * | 3/2001 | Shin | 2/161.4 |
| 6,338,163 | B1 * | 1/2002 | Markson | 2/163 |
| 6,393,614 | B1 | 5/2002 | Eichelbaum | |
| 6,421,836 | B1 | 7/2002 | Park | |
| 6,553,574 | B1 | 4/2003 | Hall, Jr. et al. | |
| 2002/0010956 | A1 | 1/2002 | Roland | |

* cited by examiner

*Primary Examiner*—Gary L. Welch
(74) *Attorney, Agent, or Firm*—Christensen O'Connor Johnson Kindness PLLC

(57) ABSTRACT

A glove includes a body having a palm sleeve with a hand entry end, an opposed end, a back of hand face and a palm face. A thumb sleeve is secured to the palm sleeve. A plurality of tubular ammunition sleeves are secured in parallel spaced relation to the back of the hand face of the palm sleeve. Each ammunition sleeve has a first end and a second end. Each ammunition sleeve is adapted to receive a single shell cartridge with a base of the shell cartridge oriented toward the first end of the ammunition sleeve. When ammunition is carried in the ammunition sleeves of the glove described above, it is much safer than carrying a loaded gun while crossing rugged terrain.

19 Claims, 4 Drawing Sheets

GLOVE WITH AMMUNITION HOLDER

FIELD OF THE INVENTION

The present invention relates to a glove for use by hunters, which is capable of holding ammunition.

BACKGROUND OF THE INVENTION

Gun Safety courses for hunters frequently teach that the hunter's gun should not be loaded until the hunter arrives in the vicinity of the intended game. The reason for this teaching is that there is a risk of the hunter shooting his companions by accident, if he should stumble crossing rugged terrain or fall while climbing over an obstacle. In some jurisdictions this has become part of hunting etiquette. In other jurisdictions this is the law. It is an unfortunate reality that hunters who obey these safety rules sometimes miss an opportunity for a shot at their intended game, when they unexpectedly flush out the game while their gun is still unloaded.

SUMMARY OF THE INVENTION

What is required is a glove in which the hunter may conveniently and safely store his ammunition.

According to the present invention there is provided a glove which includes a body having a palm sleeve with a hand entry end, an opposed end, a back of hand face and a palm face. A thumb sleeve is secured to the palm sleeve. A plurality of tubular ammunition sleeves are secured in parallel spaced relation to the back of the hand face of the palm sleeve. Each ammunition sleeve has a first end and a second end. Each ammunition sleeve is adapted to receive a single shell cartridge with a base of the shell cartridge oriented toward the first end of the ammunition sleeve.

When ammunition is carried in the ammunition sleeves of the glove described above, it is much safer than carrying a loaded gun while crossing rugged terrain. The ammunition may be rapidly accessed should a shooting opportunity present itself.

Although beneficial results may be obtained through the use of the glove, as described above, even more beneficial results may be obtained when a guard is spaced from the first end of each ammunition sleeve. The guard protects the base of the shell cartridge from impacts, which might cause the shell cartridge to fire. The glove can take various forms and there are additional features which may be added, as will hereinafter be further described in relation to the embodiments illustrated.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
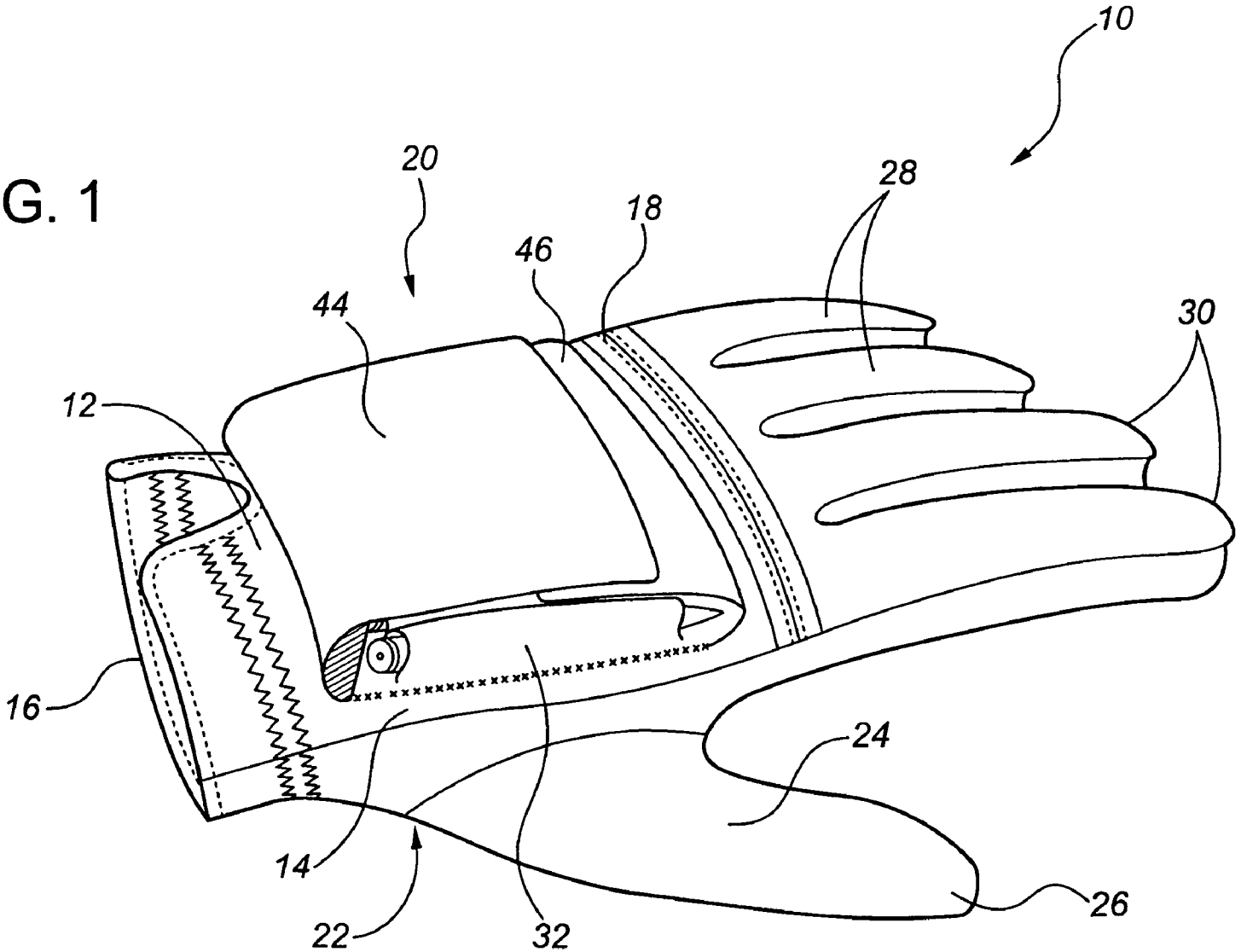
FIG. 1 is a perspective view of a glove with ammunition holder constructed in accordance with the teachings of the invention.

The preferred embodiment, a glove with ammunition holder generally identified by reference numeral 10, will now be described with reference to FIGS. 1 through 4.

Figure 2:
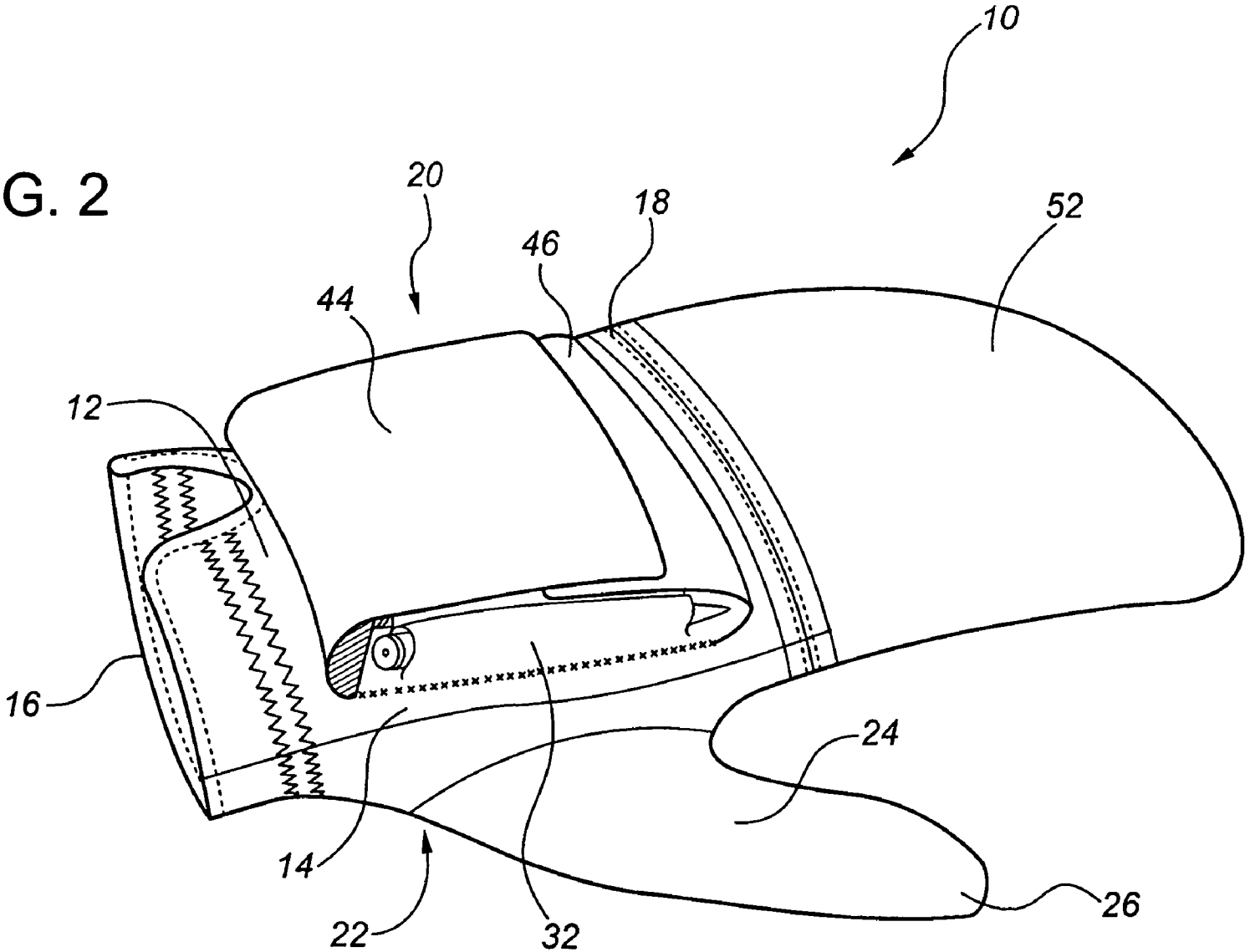
FIG. 2 is a perspective view of a glove with ammunition holder as illustrated in FIG. 1, in the form of a mitten.
Figure 3:
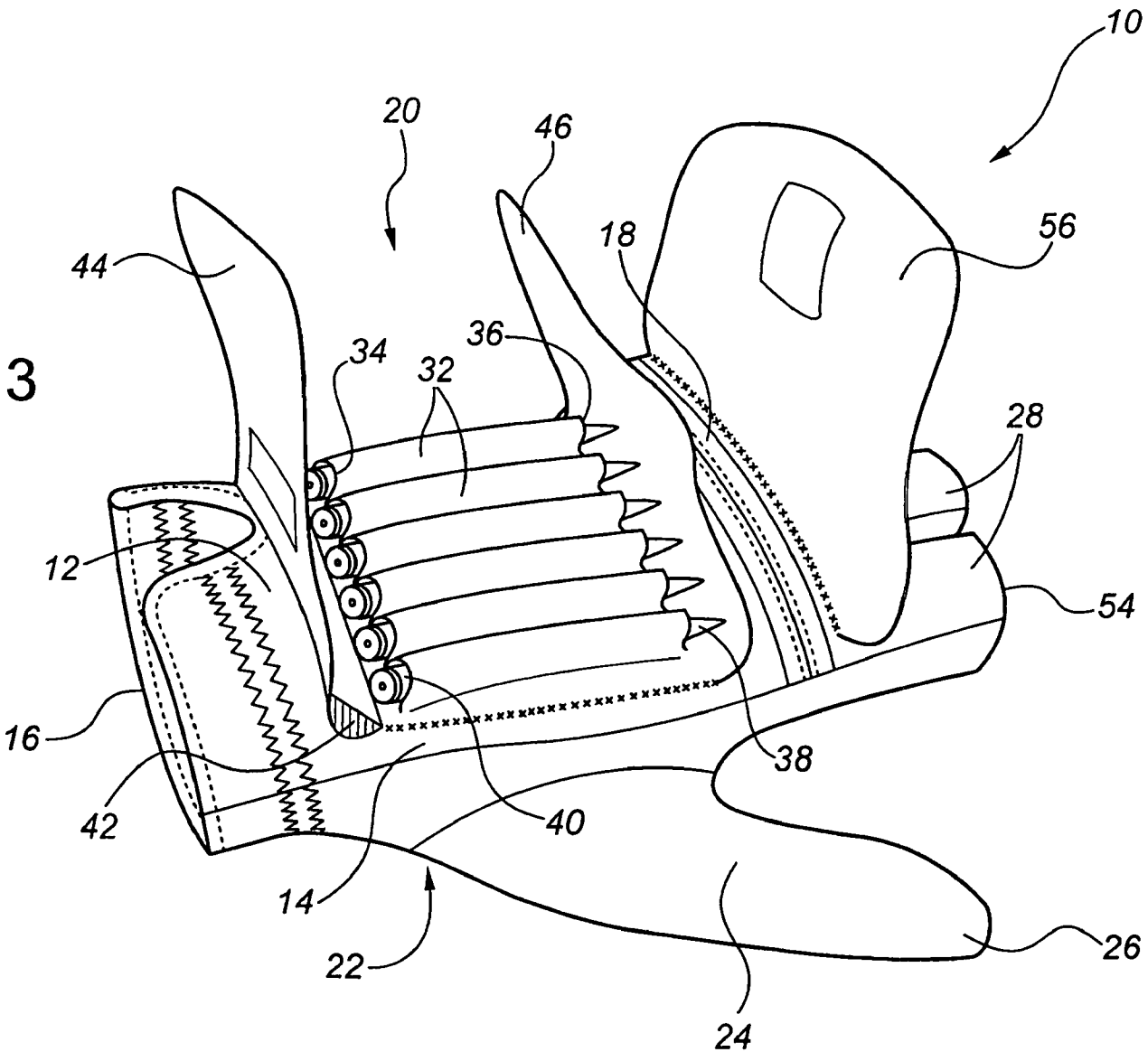
FIG. 3 is a perspective view of a glove with ammunition holder as illustrated in FIG. 1, in the form of an open-ended finger glove.
Figure 4:
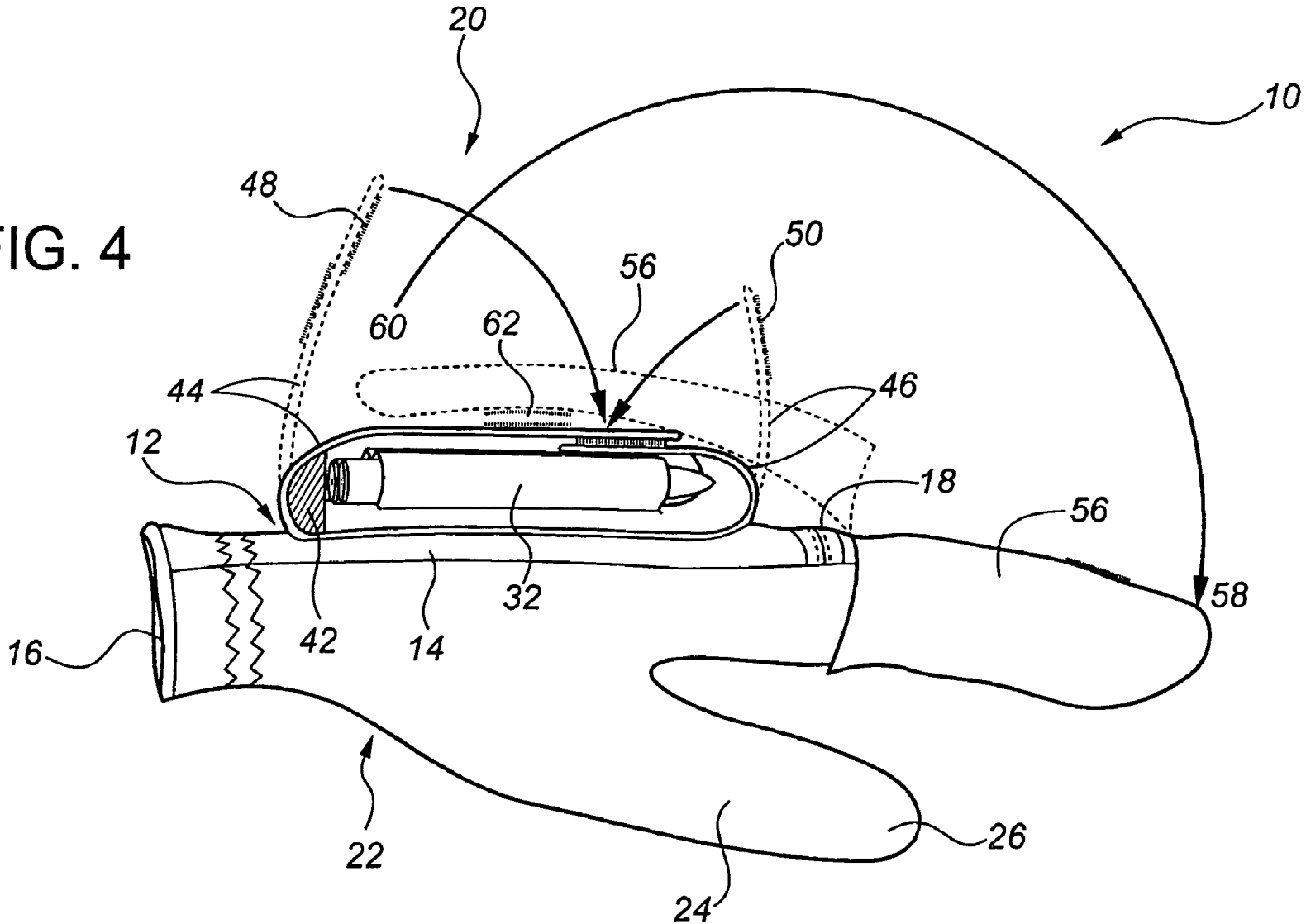
FIG. 4 is a side elevation view of a glove with ammunition holder as illustrated in FIG. 3 with flaps closed and pouch in operative position.

Referring to FIG. 1, glove 10 has a body 12 having a palm sleeve 14 which, in turn, has a hand entry end 16, an opposed end 18, a back of hand face 20 and a palm face 22. Body 12 is further adapted with a thumb sleeve 24 secured to palm sleeve 14, thumb sleeve 24 having a remote end 26 which is closed. Individual finger sleeves 28 are provided at opposed end 18 of palm sleeve 14, and have remote ends 30 which are closed. A plurality of tubular ammunition sleeves 32 are secured in parallel spaced relation to the back of hand face 20 of palm sleeve 14. Referring to FIG. 3, each ammunition sleeve 32 has a first end 34 and a second end 36 with first ends 34 of plurality of ammunition sleeves 32 oriented toward hand entry end 16 and second ends 36 of plurality ammunition sleeves 32 oriented toward opposed end 18. Each ammunition sleeve 32 is further adapted to receive a single shell cartridge 38 with a base 40 of each shell cartridge 38 oriented toward first end 34 of ammunition sleeve 32. A guard 42 is spaced from first end 34 of each ammunition sleeve 32. Guard 42 is positioned so as to protect each base 40 of each shell cartridge 38 from impacts. In the illustrated embodiment, six ammunition sleeves 32 are shown. Referring to FIG. 1, glove 10 has a first flap 44, spaced from first ends 34 of ammunition sleeves 32 and a second flap 46, spaced from second ends 36 of ammunition sleeves 32. It is preferred that guard 42 be secured to first flap 44. Referring to FIG. 4, where glove with ammunition holder 10 is open, first flap 44 has a first fastener 48 and second flap 46 has a second fastener 50 (shown in dotted lines). Where glove with ammunition holder 10 is closed, first flap 44 and second flap 46 overlap, with first fastener 48 engaging second fastener 50 (shown in solid lines). In the illustrated embodiment, first fastener 48 is the first portion of a mating tape fastener and second fastener 50 is the second portion of a mating tape fastener, one example of which is a hook and loop fastener commonly known by the trademark VELCRO. It will be appreciated that other means of fastening may be used. It will further be noted that in each embodiment of glove 10 that follows, the description of the ammunition holder is the same. Referring to FIG. 2, glove 10 has a body 12 having a palm sleeve 14 which, in turn, has a hand entry end 16, an opposed end 18, a back of hand face 20 and a palm face 22. Body 12 is further adapted with a thumb sleeve 24 secured to palm sleeve 14, thumb sleeve 24 having a remote end 26 which is closed. In the illustrated embodiment, opposed end 18 of palm sleeve 14 is closed to form a mitten 52. Referring to FIG. 3, glove 10 has a body 12 having a palm sleeve 14 which, in turn, has a hand entry end 16, an opposed end 18, a back of hand face 20 and a palm face 22. Body 12 is further adapted with a thumb sleeve 24 secured to palm sleeve 14, thumb sleeve 24 having a remote end 26 which is closed. In the illustrated embodiment, individual finger sleeves 28, having remote ends 54 which are open ended such that a wearer's fingers protrude through individual finger sleeves 28, are provided at opposed end 18 of palm sleeve 14. Further, in the illustrated embodiment, a finger covering pouch 56 is pivotally secured to back of hand face 20 of palm sleeve 14. Referring to FIG.

4, pouch 56 is movable between an operative position 58 (shown in solid lines), covering remote ends 54 of individual finger sleeves 28, and a stored position 60 (shown in dotted lines), substantially parallel to back of hand face 20 of palm sleeve 14. A fastener 62 is provided to maintain pouch 56 in stored position 60. In the illustrated embodiment, fastener 62 is a mating tape fastener similar to one used to secure first flap 44 and second flap 46. It will be appreciated that other means of fastening may be used.

It will be appreciated by one skilled in the art, that the present invention provides rapid and easy access of ammunition. In the past, hunters have carried ammunition in their pockets. The rattling noise made by the ammunition has sometimes scared game away. The present invention eliminates any such noise.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The invention claimed is:

1. A glove, comprising:

a body having a palm sleeve having a hand entry end, an opposed end, a back of hand face and a palm face;

a thumb sleeve secured to the palm sleeve;

a plurality of open ended tubular ammunition sleeves secured in parallel spaced relation to the back of the hand face of the palm sleeve, each ammunition sleeve having a first end and a second end, each ammunition sleeve being adapted to receive a single shell cartridge;

a first flap spaced from and positioned transversely across the first end of the ammunition sleeves thereby blocking the first end of the ammunition sleeves; and a second flap spaced from and positioned transversely across the second end of the ammunition sleeves thereby blocking the second end of the ammunition sleeves, each of the first flap and the second flap being movable between a flaps open position and a flaps closed position, in the flaps open position the first flap and the second flap are pivoted out of the way to permit access to the ammunition sleeves, in the flaps closed position the first flap closes the first end and the second flap closes the second end of the ammunition sleeves.

2. The glove as defined in claim 1, wherein a guard is spaced from the first end of each ammunition sleeve, the guard being adapted to protect the base of the shell cartridge from impacts, which might cause the shell cartridge to fire.

3. The glove as defined in claim 1, wherein the first ends of the ammunition sleeves are oriented toward the hand entry end and the second ends of the ammunition sleeves are oriented toward the opposed end.

4. The glove as defined in claim 1, wherein individual finger sleeves are provided at the opposed end of the palm sleeve.

5. The glove as defined in claim 4, wherein the individual finger sleeves have remote ends which are open ended, such that a wearer's fingers protrude through the individual finger sleeves.

6. The glove as defined in claim 5, wherein a pouch is pivotally secured to the back of hand face of the palm sleeve, the pouch being movable from an operative position covering the remote ends of the individual finger sleeves, and a stored position substantially parallel to the back of hand face of the palm sleeve.

7. The glove as defined in claim 4, wherein the individual finger sleeves have remote ends which are closed.

8. The glove as defined in claim 1, wherein the opposed end of the palm sleeve is closed to form a mitten.

9. The glove as defined in claim 1, the first flap has a first fastener and the second flap has a second fastener, the first flap and the second flap overlapping with the first fastener engaging the second fastener.

10. The glove as defined in claim 9, wherein the first fastener is a first portion of a mating tape fastener and the second fastener is a second portion of the mating tape fastener.

11. A glove, comprising:

a body having a palm sleeve having a hand entry end, an opposed end, a back of hand face and a palm face;

a thumb sleeve secured to the palm sleeve, the thumb sleeve having a remote end which is closed;

individual finger sleeves are provided at the opposed end of the palm sleeve, the individual finger sleeves having remote ends which are closed;

a plurality of tubular ammunition sleeves secured in parallel spaced relation to the back of the hand face of the palm sleeve, each ammunition sleeve having a first end and a second end with the first ends of the ammunition sleeves oriented toward the hand entry end and the second ends of the ammunition sleeves oriented toward the opposed end, each ammunition sleeve being adapted to receive a single shell cartridge with a base of the shell cartridge oriented toward the first end of the ammunition sleeve;

a first flap spaced from and positioned transversely across the first end of the ammunition sleeves thereby blocking the first end of the ammunition sleeves, and a second flap spaced from and positioned transversely across the second end of the ammunition sleeves thereby blocking the second end of the ammunition sleeves, each of the first flap and the second flap being movable between a flaps open position and a flaps closed position, in the flaps open position the first flap and the second flap are pivoted out of the way to permit access to the ammunition sleeves, in the flaps closed position the first flap closes the first end and the second flap closes the second end of the ammunition sleeves; and a guard spaced from the first end of each ammunition sleeve, the guard being adapted to protect the base of the shell cartridge from impacts, which might cause the shell cartridge to fire.

12. The glove as defined in claim 11, wherein the first flap has a first fastener and the second flap has a second fastener, the first flap and the second flap overlapping with the first fastener engaging the second fastener, the guard being secured to the first flap.

13. The glove as defined in claim 12, wherein the first fastener is a first portion of a mating tape fastener and the second fastener is a second portion of the mating tape fastener.

14. A glove, comprising:

a body having a palm sleeve having a hand entry end, an opposed end, a back of hand face and a palm face;

a thumb sleeve secured to the palm sleeve, the thumb sleeve having a remote end which is closed;

the opposed end of the palm sleeve being closed to form a mitten;

a plurality of tubular ammunition sleeves secured in parallel spaced relation to the back of the hand face of the palm sleeve, each ammunition sleeve having a first end and a second end with the first ends of the ammunition sleeves oriented toward the hand entry end and the second ends of the ammunition sleeves oriented toward the opposed end, each ammunition sleeve being adapted to receive a single shell cartridge with a base of the shell cartridge oriented toward the first end of the ammunition sleeve;

a first flap spaced from and positioned transversely across the first end of the ammunition sleeves thereby blocking the first end of the ammunition sleeves, and a second flap spaced from and positioned transversely across the second end of the ammunition sleeves thereby blocking the second end of the ammunition sleeves, each of the first flap and the second flap being movable between a flaps open position and a flaps closed position, in the flaps open position the first flap and the second flap are pivoted out of the way to permit access to the ammunition sleeves, in the flaps closed position the first flap closes the first end and the second flap closes the second end of the ammunition sleeves; and a guard spaced from the first end of each ammunition sleeve, the guard being adapted to protect the base of the shell cartridge from impacts, which might cause the shell cartridge to fire.

15. The glove as defined in claim 14, wherein the first flap has a first fastener and the second flap has a second fastener, the first flap and the second flap overlapping with the first fastener engaging the second fastener, the guard being secured to the first flap.

16. The glove as defined in claim 15, wherein the first fastener is a first portion of a mating tape fastener and the second fastener is a second portion of the mating tape fastener.

17. A glove, comprising:

a body having a palm sleeve having a hand entry end, an opposed end, a back of hand face and a palm face;

a thumb sleeve secured to the palm sleeve, the thumb sleeve having a remote end which is closed;

individual finger sleeves are provided at the opposed end of the palm sleeve, the individual finger sleeves having remote ends which are open ended, such that a wearer's fingers protrude through the individual finger sleeves;

a finger covering pouch pivotally secured to the back of hand face of the palm sleeve, the pouch being movable from an operative position covering the remote ends of the individual finger sleeves, and a stored position substantially parallel to the back of hand face of the palm sleeve, a fastener being provided to maintain the finger covering pouch in the stored position;

a plurality of tubular ammunition sleeves secured in parallel spaced relation to the back of the hand face of the palm sleeve, each ammunition sleeve having a first end and a second end with the first ends of the ammunition sleeves oriented toward the hand entry end and the second ends of the ammunition sleeves oriented toward the opposed end, each ammunition sleeve being adapted to receive a single shell cartridge with a base of the shell cartridge oriented toward the first end of the ammunition sleeve;

a first flap spaced from and positioned transversely across the first end of the ammunition sleeves thereby blocking the first end of the ammunition sleeves, and a second flap spaced from and positioned transversely across the second end of the ammunition sleeves thereby blocking the second end of the ammunition sleeves, each of the first flap and the second flap being movable between a flaps open position and a flaps closed position, in the flaps open position the first flag and the second flap are pivoted out of the way to permit access to the ammunition sleeves, in the flaps closed position the first flap closes the first end and the second flap closes the second end of the ammunition sleeves; and a guard spaced from the first end of each ammunition sleeve, the guard being adapted to protect the base of the shell cartridge from impacts, which might cause the shell cartridge to fire.

18. The glove as defined in claim 17, wherein the first flap has a first fastener and the second flap has a second fastener, the first flap and the second flap overlapping with the first fastener engaging the second fastener, the guard being secured to the first flap.

19. The glove as defined in claim 18, wherein the first fastener is a first portion of a mating tape fastener and the second fastener is a second portion of the mating tape fastener.

* * * * *

UNITED STATES PATENT AND TRADEMARK OFFICE

CERTIFICATE OF CORRECTION

PATENT NO. : 7,117,541 B2
APPLICATION NO. : 10/958990
DATED : October 10, 2006
INVENTOR(S) : M.G. Hozack It is certified that error appears in the above-identified patent and that said Letters Patent is hereby corrected as shown below:

| COLUMN | LINE | ERROR |
|---|---|---|
| 6 (Claim 17, line 35) | 27 | "first flag" should read --first flap-- |

Signed and Sealed this

Twenty-seventh Day of March, 2007

JON W. DUDAS
*Director of the United States Patent and Trademark Office*